US005732637A

United States Patent [19]

Raab

[11] Patent Number: 5,732,637

[45] Date of Patent: Mar. 31, 1998

[54] LIGHTWEIGHT PLASTIC FURNITURE

[75] Inventor: Clifford Raab, Palm Harbor, Fla.

[73] Assignee: Virco Mfg. Corporation, Torrance, Calif.

[21] Appl. No.: 547,658

[22] Filed: Oct. 24, 1995

[51] Int. Cl.[6] ..... A47B 13/00

[52] U.S. Cl. ..... 108/129; 52/789.1; 108/161

[58] Field of Search ..... 108/129, 131, 108/161, 901, 115; 52/789.1, 793.11, 783.11

[56] References Cited

U.S. PATENT DOCUMENTS

| | | |
|---|---|---|
| 1,542,138 | 1/1925 | Hunter . |
| 3,164,110 | 1/1965 | Bofinger . |
| 3,319,958 | 5/1967 | Bender . |
| 3,628,470 | 12/1971 | DeLuca . |
| 4,951,567 | 8/1990 | Cobos et al. . |
| 5,271,338 | 12/1993 | Bonham . |
| 5,394,808 | 3/1995 | Dutro et al. . |
| 5,443,020 | 8/1995 | Price . |

FOREIGN PATENT DOCUMENTS

| | | | |
|---|---|---|---|
| 1371706 | 7/1964 | France | 52/789.1 |

*Primary Examiner*—Peter M. Cuomo
*Assistant Examiner*—Gerald A. Anderson
*Attorney, Agent, or Firm*—J. E. Brunton

[57] ABSTRACT

A lightweight, high-strength support platform for use in furniture construction, which has superior structural integrity and can be used, by way of example, in portable folding tables, in work tables and in modular furniture of the character typically used in modern office complexes. The support platform embodies a novel structural reinforcement core of a unique configuration which is both lightweight and exhibits superior strength and durability characteristics. In one form of the invention, the support platform is used in the construction of a lightweight, readily portable folding table which includes two pair of legs that are pivotally connected to the platform for pivotal movement between an extended operational position and a retracted storage and transport position.

7 Claims, 9 Drawing Sheets

FIG. 1
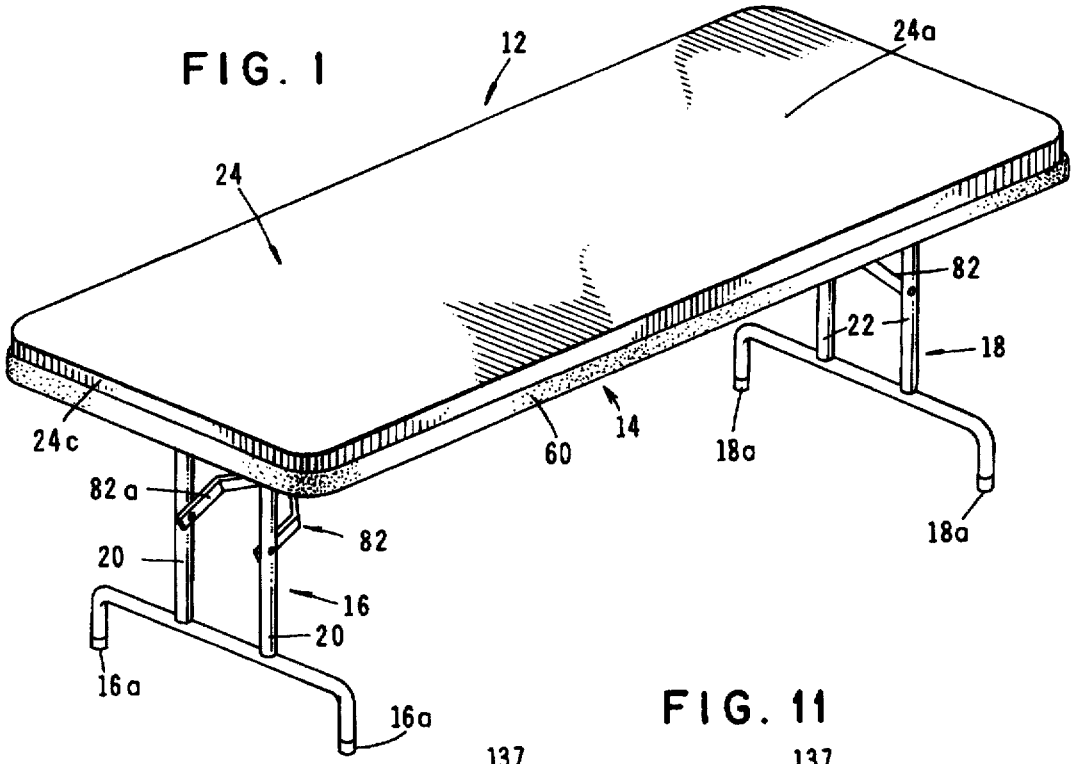
FIG. 11
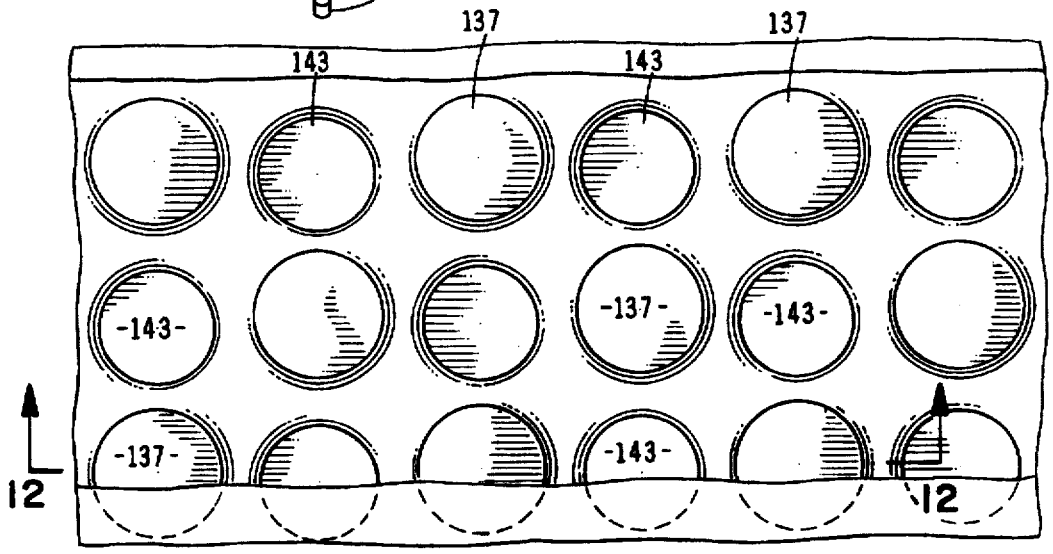
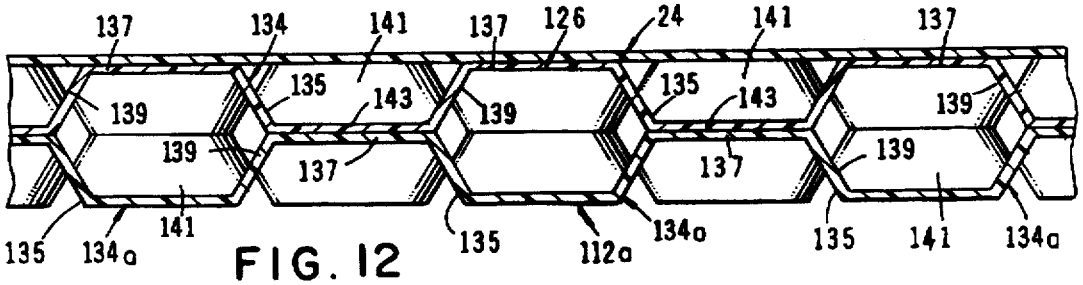
FIG. 12

LIGHTWEIGHT PLASTIC FURNITURE

BACKGROUND OF THE INVENTION

FIELD OF THE INVENTION

The present invention relates generally to plastic furniture. More particularly, the invention concerns a lightweight plastic folding table having a novel, structurally reinforced support platform providing a work surface.

DISCUSSION OF THE INVENTION

Lightweight furniture which exhibits superior structural characteristics is in wide demand for many industrial and institutional applications. Entities having great need for such furniture include schools, convention centers, hotels, factories, business offices and various governmental entities. Particularly in demand are lightweight folding tables and lightweight modular units for use in offices and the like which are readily portable and easily storable when not in use.

While many types of lightweight furniture have been suggested in the past, a typical drawback of such furniture is a lack of structural integrity which tends to contribute to limited useful life and to frequent structural failures. As a general rule, when the prior art furniture designers have attempted to correct the structural deficiencies in the prior art designs, the furniture becomes excessively heavy and unduly bulky. As will be discussed in greater detail in the paragraphs that follow, the thrust of the present invention is to provide lightweight, readily portable furniture which embodies a unique structural reinforcement core that provide superior structural integrity to the furniture without unduly increasing its weight or bulkiness.

Exemplary of typical prior art plastic folding tables are those described in U.S. Pat. No. 4,951,576 issued to Cobos et al. The Cobos et al tables include upper and lower plastic table top halves and a framework grid, preferably made of wood, sandwiched therebetween. Another example of a prior art folding table is that described in U.S. Pat. No. 5,394,808 issued to Dutro et al. This table has a unitary table top formed of molded plastic preferably having an outer shell of non-cellular plastic with a filling of lightweight hardened foam. Other examples of prior art table constructions can be found in U.S. Pat. No. 5,271,338 issued to Bonham and in U.S. Pat. No. 3,628,470 issued to DeLucas.

SUMMARY OF THE INVENTION

It is an object of the present invention to provide a lightweight, high-strength support platform for use in furniture construction, which has superior structural integrity and can be used, by way of example, in portable folding tables, in work tables and in modular furniture of the character typically used in modern office complexes.

More particularly, it is an object of the invention to provide a lightweight support platform of the aforementioned character which embodies a highly novel structural reinforcement core which is both lightweight and exhibits superior strength and durability characteristics.

Another object of the invention is to provide a lightweight, readily portable folding table which embodies a lightweight plastic support platform of the character described in the preceding paragraphs and which the table further includes pivotally mounted legs that can be pivoted from an extended operational position into a retracted storage and transport position wherein they abut the reinforcement core of the support platform.

Another object of the invention is to provide a lightweight folding table of the aforementioned character which is unusually strong, is highly reliable in use and has a long useful life.

Another object of the invention is to provide a lightweight, high-strength foldable table of the character described which is constructed from readily available moldable plastic materials and one which can be efficiently and inexpensively manufactured in high volume.

Still another object of the invention is to provide a light weight folding table of the class described in the preceding paragraphs which is highly attractive and easy to operate.

BRIEF DESCRIPTION OF THE DRAWINGS

FIG. 1 is a generally perspective view of one embodiment of the lightweight plastic furniture of the present invention shown there as a lightweight folding table.

FIG. 11 is a greatly enlarged fragmentary plan view of an alternate form of support member of the invention.

FIG. 12 is a cross-sectional view taken along lines 12—12 of FIG. 11.

DESCRIPTION OF THE INVENTION

Figure 2A:
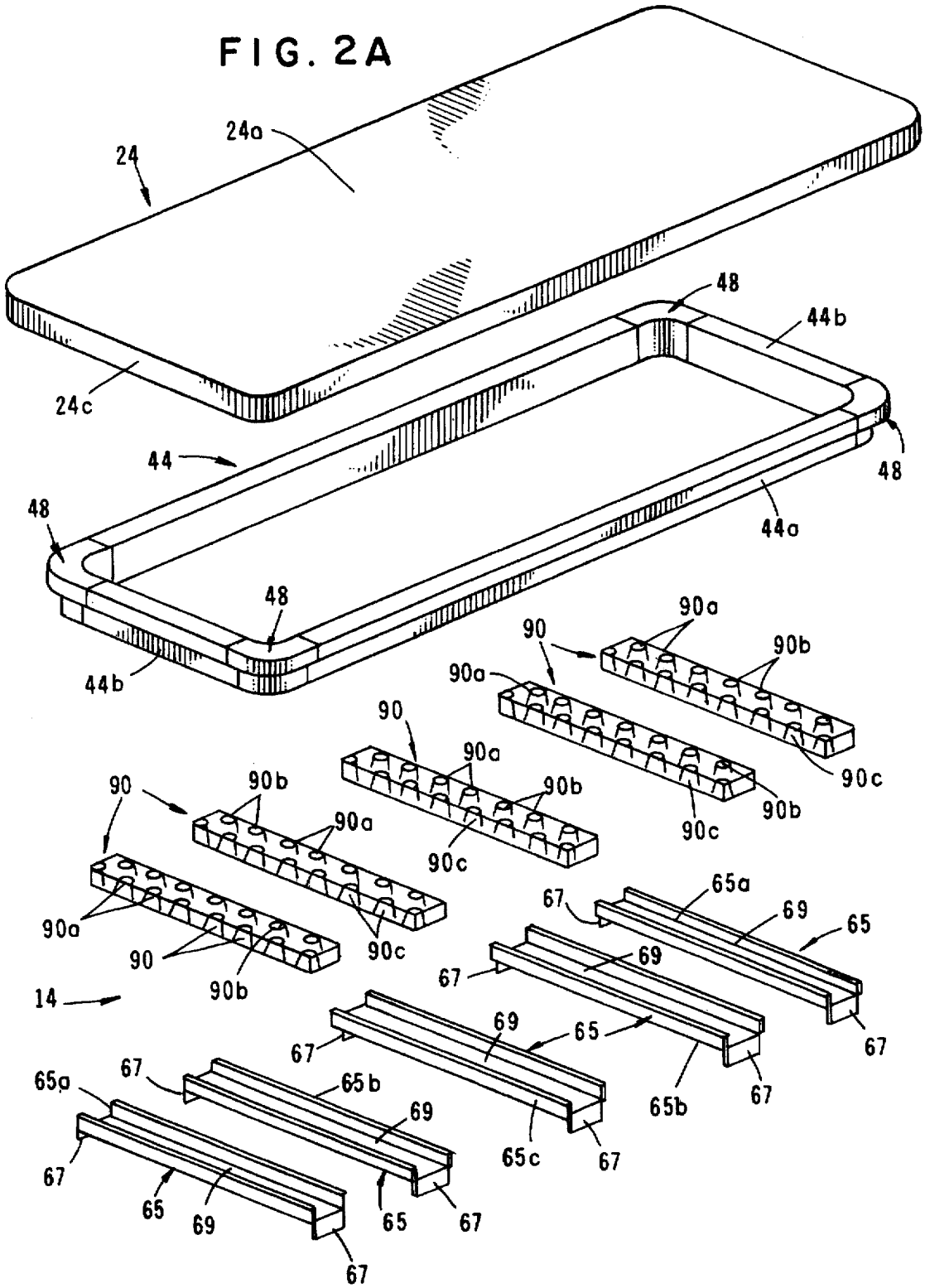
FIGS. 2A and 2B together comprise a generally perspective, exploded view of the folding table construction shown in FIG. 1.
Figure 2B:
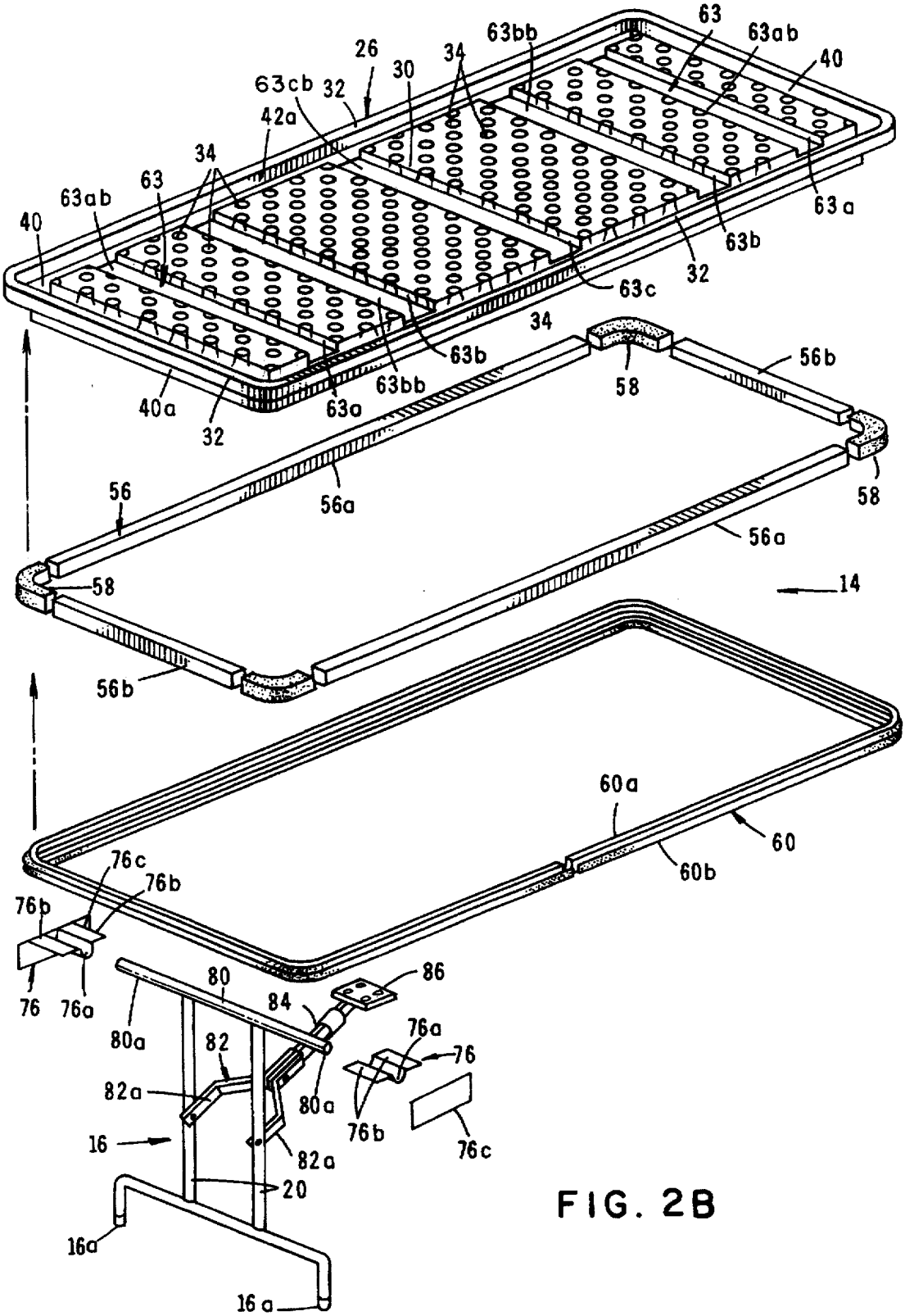

Referring to the drawings and particularly to FIGS. 1, 2A and 2B, one form of the lightweight, high strength folding table of the present invention is there illustrated and generally designated by the numeral 12. The folding table of this form of the invention comprises a support platform assembly 14 and first and second leg assemblies 16 and 18, each of which comprises a pair of downwardly extending legs designated in FIG. 1 as 20 and 22, which legs are pivotally connected to platform 14.

An important feature of the present invention is the uniquely configured support platform 14 which is used in the construction of table 12. Referring particularly to FIGS. 2A and 2B, this novel support platform can be seen to comprise a support member or cover 24 which defines a work surface 24*a* and a structural reinforcement panel 26 (FIG. 2B) which is connected to support member 24 in a manner presently to be described.

Figure 4:
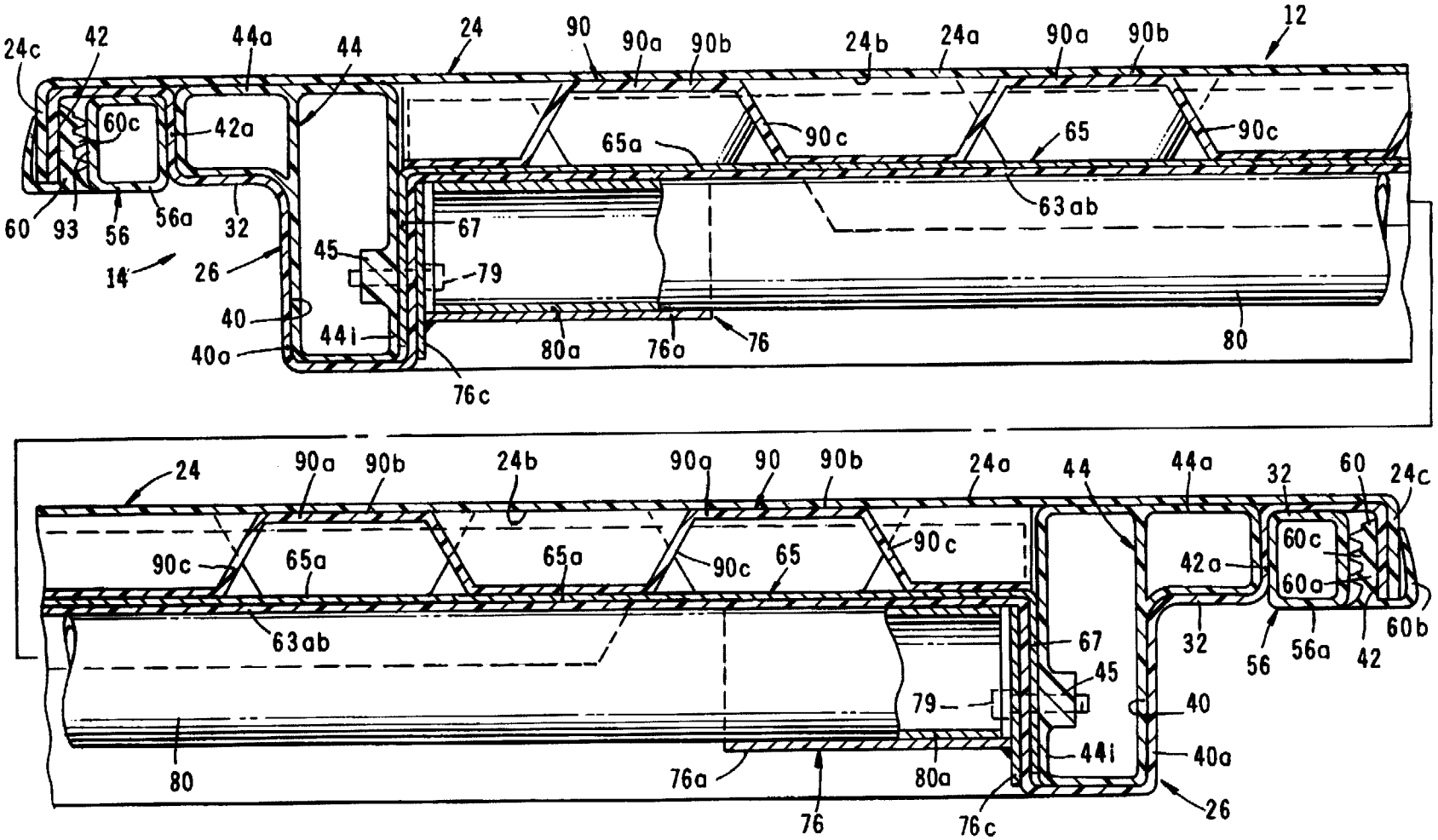
FIG. 4 is an enlarged, cross-sectional view taken along lines 4—4 of FIG. 3B.

As best seen in FIGS. 2A and 4, support member 24 includes a generally planar first or work surface 24a as well as a second generally planar surface 24b which is spaced apart from surface 24a. Additionally, support member 24 includes a peripheral side wall 24c which circumscribes first surface 24a and defines a downwardly depending, skirt-like portion of the character best seen in FIG. 2A. Support member 24 can be constructed from a number of different types of moldable plastic materials such as polyethylene, styrene, polyproplyline and like materials. However, acrylonitrile butadiene styrene (ABS) is preferred.

Figure 5:
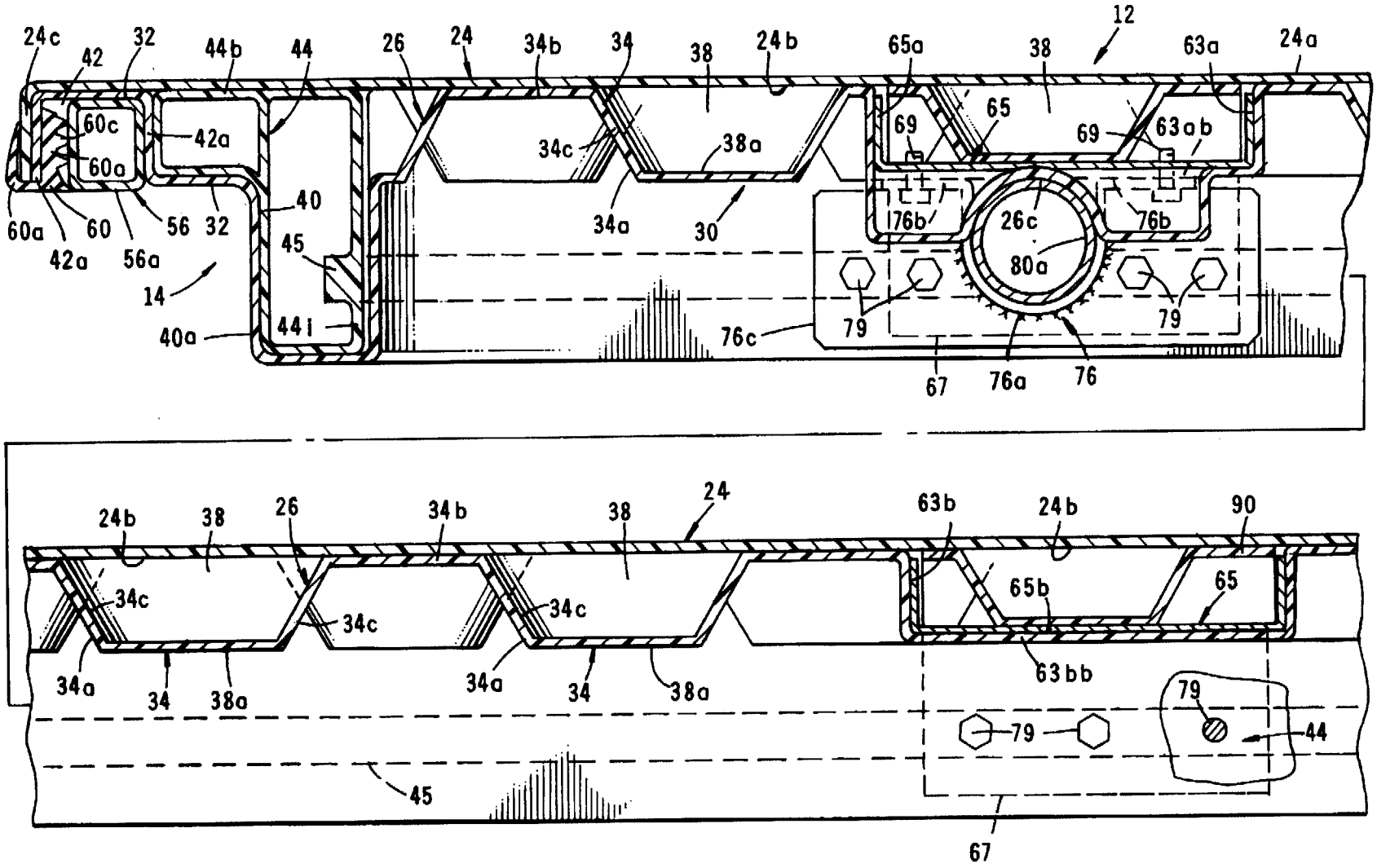
FIG. 5 is an enlarged, cross-sectional view taken along lines 5—5 of FIG. 3B.

An important aspect of the support platform construction of the present invention is the uniquely configured, relatively thin plastic reinforcement panel 26. As illustrated in FIGS. 4 and 5 reinforcement panel 26 is interconnected with support member 24 and functions in a novel manner to provide substantial structural support to member 24 so that work surface 24a can withstand substantial vertical loading. Panel 26 can also be constructed from various moldable plastic materials of the character described in the preceding paragraph, but once again ABS is preferred. Depending upon the material selected, panel 26 can be vacuum formed, injection molded or molded in a number of other ways well known to those skilled in the art.

Figure 9:
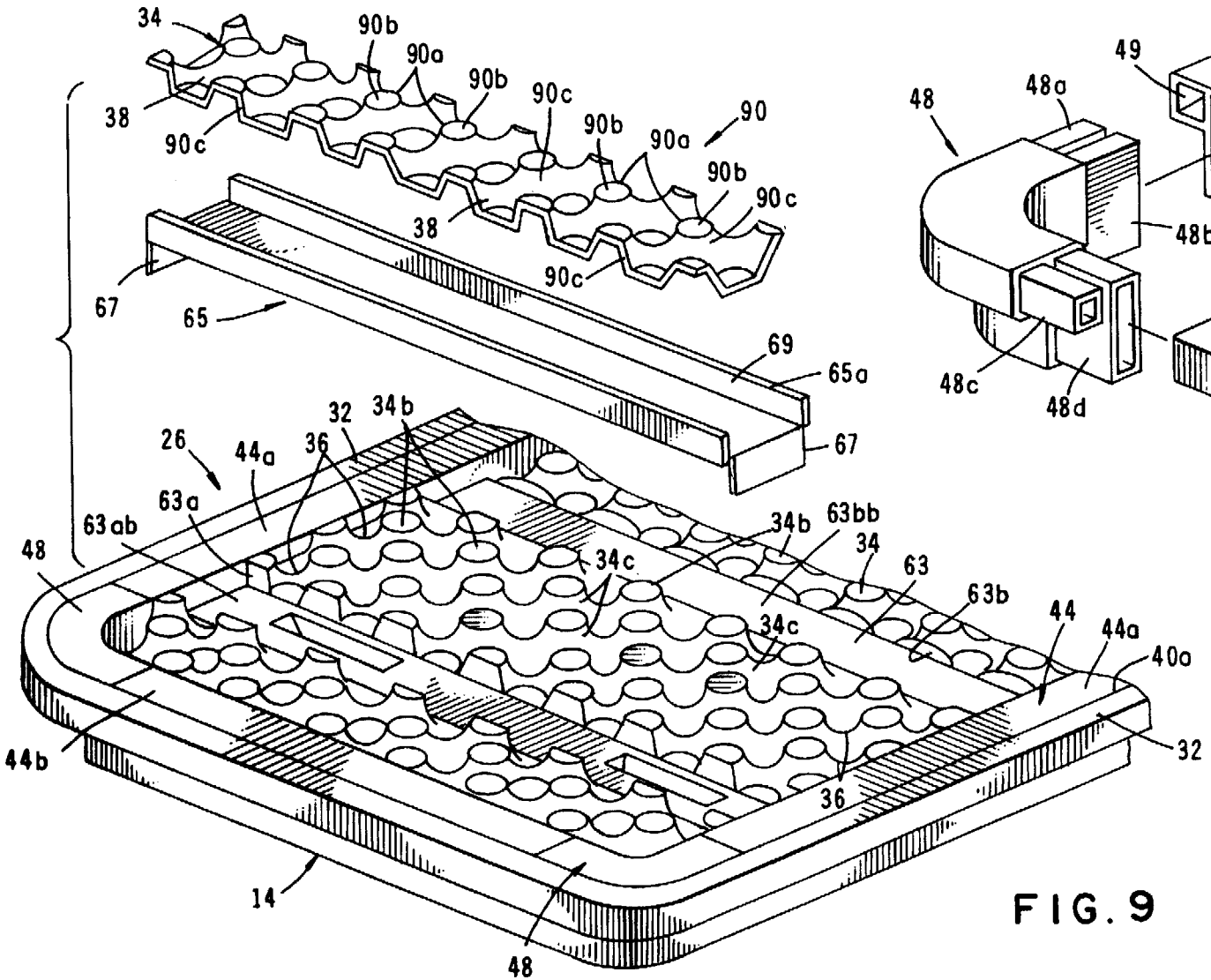
FIG. 9 is a generally perspective, fragmentary, exploded view of a portion of the support platform of the invention which is used in the construction of the folding table shown in FIG. 1.

Referring particularly to FIGS. 2B and 5, the novel reinforcement panel 26 can be seen to include a central portion 30 and a peripheral portion 32 which circumscribes central portion 30. The central portion is uniquely formed to provide a multiplicity of spaced-apart, specially configured upstanding protuberances 34. As shown in FIG. 5, each protuberance 34 comprises a base portion 34a, a vertically spaced-apart, generally circular-shaped closure wall 34b (FIG. 9), and a tapered connecting wall 34c which interconnects base portion 34a and closure wall 34b (FIG. 5). While protuberances 34 are shown in the drawings as being generally frustoconical in shape, the protuberances can take on a wide variety of shapes. For example, top wall 34b of each protuberance, rather than being circular in shape, could be hexagonal or octagonal in shape should the designer so desire. Referring particularly to FIG. 9, it is to be noted that a multiplicity of web-like structures 36 interconnect protuberances 34 so as to provide additional strength to the reinforcement panel. As seen by also referring to FIG. 5, a multiplicity of cavities 38 are provided intermediate protuberances 34. Cavities 38 are also generally frustoconical in shape and terminate in base closure walls 38a.

Figure 3A:
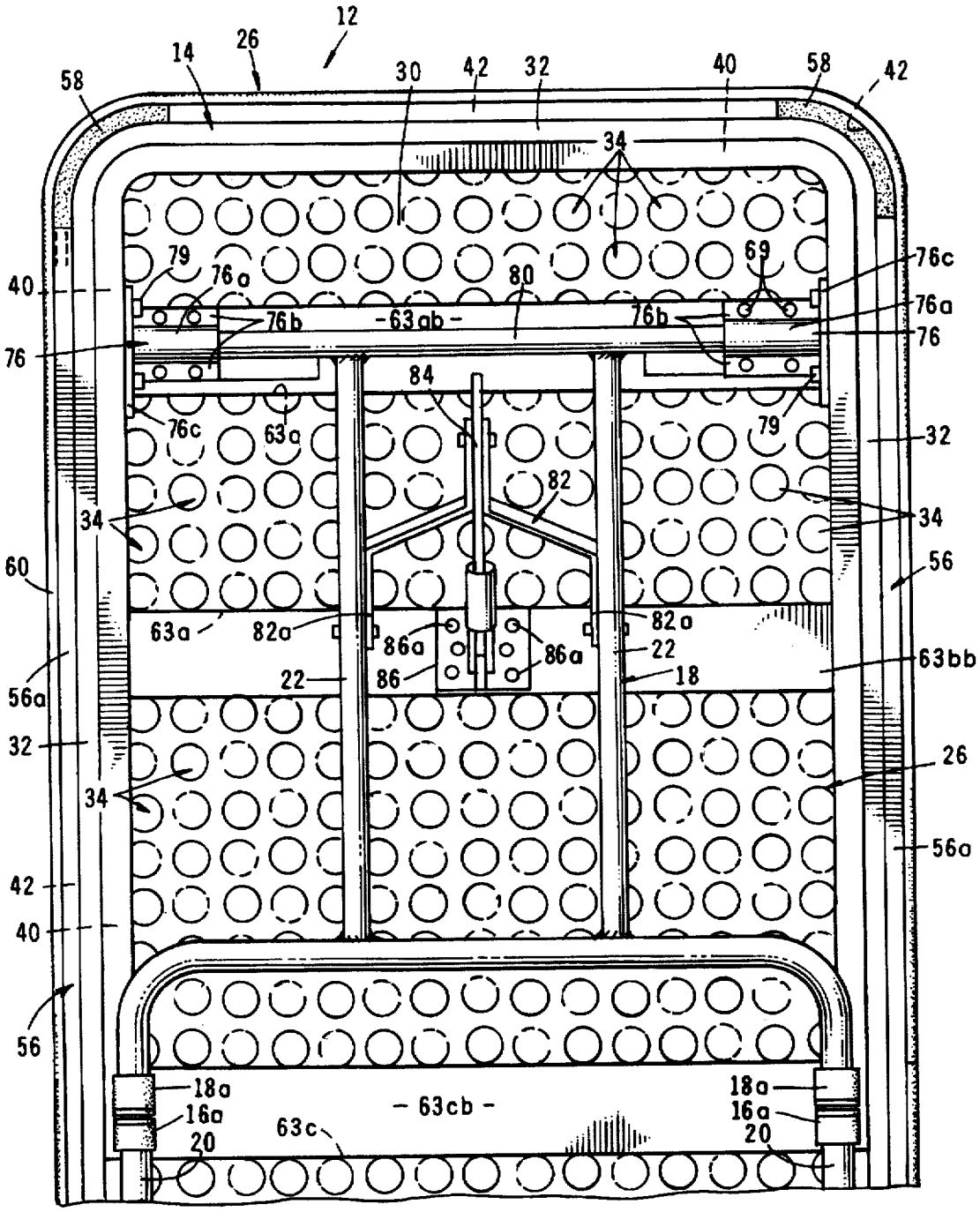
FIGS. 3A and 3B together comprise enlarged bottom plan view of the folding table construction shown in FIG. 1.
Figure 3B:
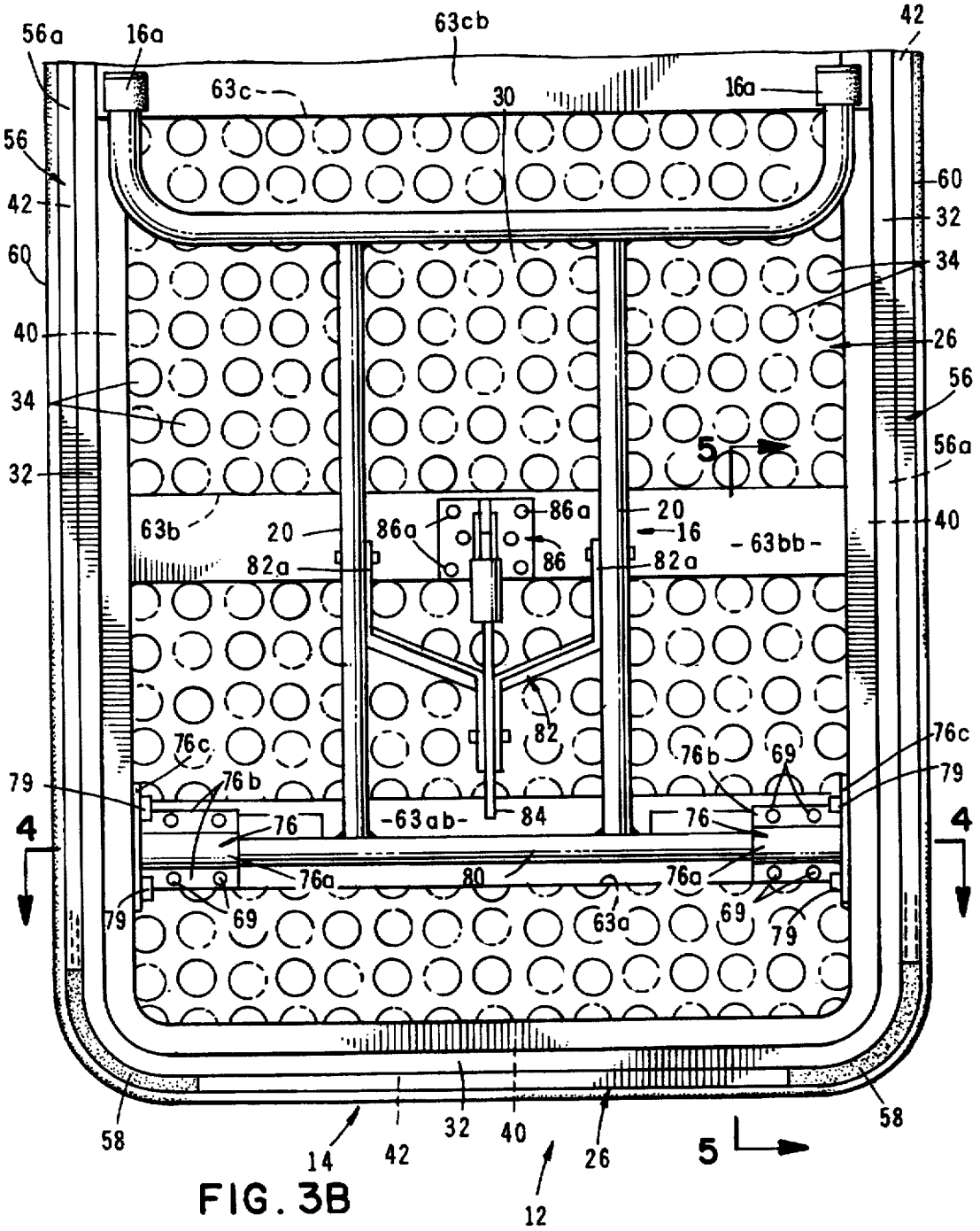

The peripheral portion of the reinforcement panel is also uniquely configured and, as illustrated in FIG. 5, comprises a first channel 40 which is defined by a downwardly extending generally "U" shaped wall portion 40a which forms a part of peripheral portion 32 of the reinforcement panel. A second channel 42 is also formed in peripheral portion 32 of the structural panel and is defined by a generally "U" shaped, upwardly extending wall 42a which also forms a part of the peripheral portion of the reinforcement panel. As best seen in FIGS. 3A and 3B, both channels circumscribe central portion 30 of the reinforcement panel with second channel 42 also circumscribing channel 40 (see also FIG. 2A).

Figure 6:
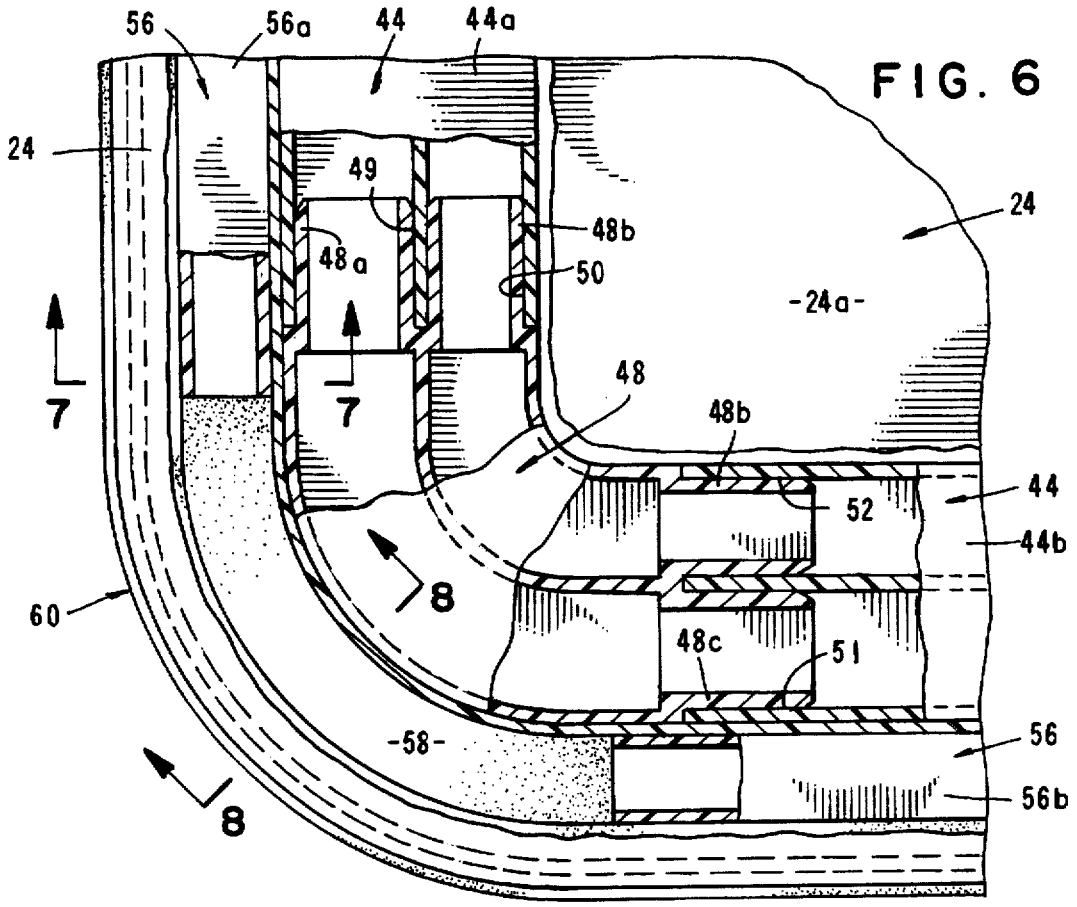
FIG. 6 is a greatly enlarged, top plan view of a corner construction of the folding table of the invention partly broken away to show internal construction.
Figure 10:
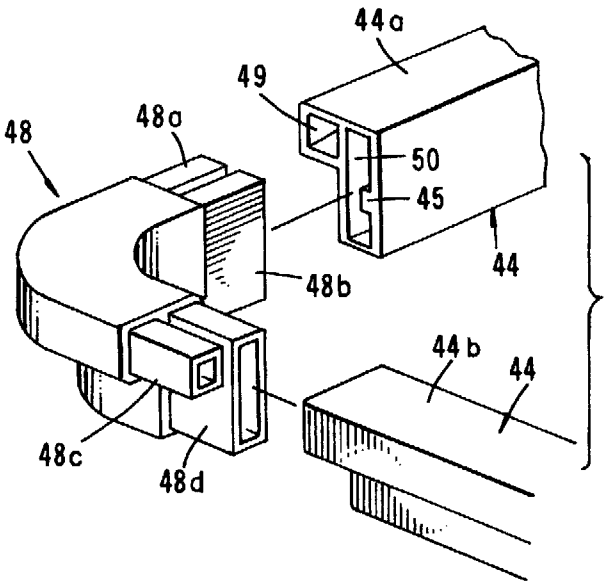
FIG. 10 is a generally perspective, exploded view illustrating the construction of one corner of the reinforcement frame of the folding table construction shown in FIG. 1.

Receivable within channel-shaped portion 40 is a generally rectangular shaped reinforcement frame 44 (FIGS. 2A and 5). Reinforcement frame 44 includes a pair of spaced apart, longitudinally extending structural beams or extrusions 44a and a pair of spaced apart transversely extending beams or extrusions 44b. As illustrated in FIG. 10, beams 44a and 44b are interconnected by four corner assemblies 48 of novel design, each of which includes a pair of outwardly extending tongues 48a and 48b. Tongues 48a and 48b are closely receivable within openings 49 and 50 respectively which are provided in beams 44a. In similar manner, each corner assembly 48 also includes outwardly extending tongue-like portions 48c and 40 which are receivable in correspondingly shaped openings 51 and 52 provided in beam 44b (see also FIG. 6). Beams or extrusions 44a and 44b are preferably formed of a rigid, high strength, plastic material as are the corner assemblies 48. As shown in FIG. 2A, a corner assembly 48 is provided at each corner of reinforcement frame 44 to provide a closed frame of substantial strength. Reinforcement frame 44 can simply rest within channel 40 or, if desired, can be secured within the channel by any suitable means such as by adhesive bonding.

Receivable within channel-like portion 42 of the reinforcement panel is a generally rectangular shaped edge support frame 56. As shown in FIG. 2B, frame 56 also comprises a pair of spaced-apart, longitudinally extending beam-like members or extrusions 56a and a pair of transversely extending bean-like extrusions or structural members 56b. Members 56a and 56b are joined at their ends to arcuately shaped, resiliently deformable corner members 58. Corner members 58 comprise cushioning means for cushioning impact forces imposed on the support platform during transport and storage and are preferably formed of a resiliently deformable, relatively hard elastomer such as natural or synthetic rubber. If desired, corner members 58 can be interconnected with beams 56a and 56b in any suitable manner such adhesive bonding. Similarly, edge support frame 56 can simply rest within channel 42 or, if desired, can be secured in place within the channel by any suitable means such as adhesive bonding. Reinforcement beams 44a, 44b, 56a, 56b can be constructed of various plastics of the character previously discussed but once again ABS comprises the material of choice.

Figure 7:
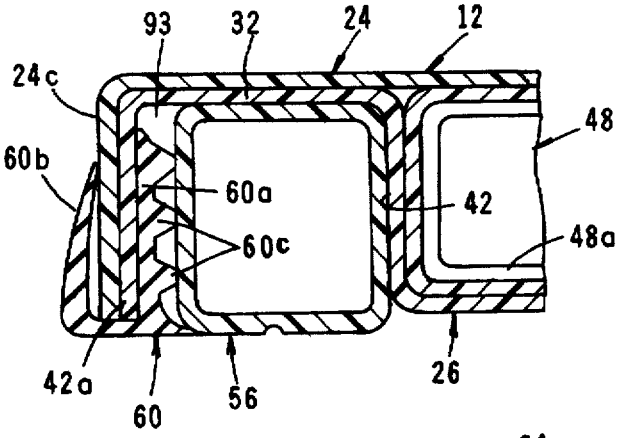
FIG. 7 is an enlarged, cross-sectional view taken along lines 7—7 of FIG. 6.
Figure 8:
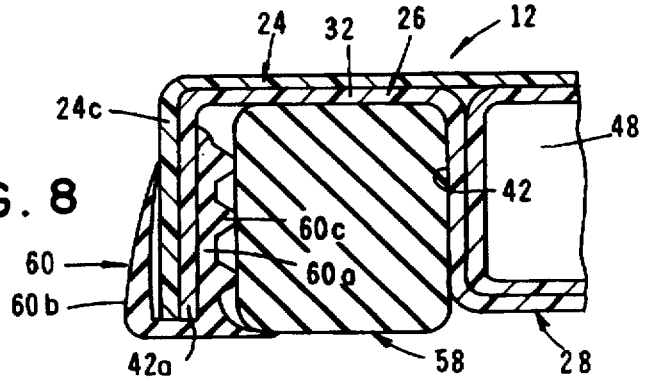
FIG. 8 is an enlarged, cross-sectional view taken along lines 8—8 of FIG. 6.

As illustrated in FIGS. 2B and 5, a resiliently deformable sealing means or trim frame 60 is also receivable within channel 42 in the manner shown in the drawings. More particularly, as best seen in FIGS. 7 and 8, trim member 60 includes a first upstanding finger-like projection 60a which is disposed between edge frame 56 and outer wall of the channel-defining walls 42a of panel 26. To securely wedge frame 56 into channel 42 in the manner shown in FIGS. 8 and 9, a plurality of outwardly extending rib-like protuberances 60c are provided on projection 60a. Trim member 60 also includes a second, upwardly extending, finger-like projection 60b which is spaced from projection 60a so as to be closely receivable over a portion of skirt portion 24c of support member 24 when member 24 is assembled over panel 26. Trim or sealing frame 60 can be constructed of a variety of moldable plastic materials such as polyvinyl chloride, polyethlyene, and butyrate and functions to seal and attractively trim out the lower edge portion of the platform assembly in the manner best seen in FIG. 5.

Another important feature of the apparatus of the present invention of the invention comprises anchor means for use in securely interconnecting leg assemblies 16 and 18 to the support platform. These anchor means are here provided in the form of a plurality of anchor plates 65 to which the folding legs of the table can be securely interconnected. In the embodiment of the invention shown in the drawings, anchor plates 65 are positioned within transversely extending, longitudinally, spaced-apart anchor plate receiving grooves 63 which are formed in central portion 30 of reinforcement panel 26 (FIG. 2B). More particularly, those anchor plates designated in the drawings as 65a are received within the grooves designated in the drawings as 63a, while the anchor plates designated as 65b are received within the grooves identified by the numerals 63b. A centrally disposed anchor plate 65c is closely received within a central groove 63c formed in reinforcement panel 26. Groove 63c functions to receive the ground engaging extremities 16a and 18a of the leg assemblies when the leg assemblies are retracted in the manner shown in the FIGS. 2A and 2B.

Anchor plates 65 can be constructed of thin sheet metal such as steel or aluminum, and each is provided with downwardly extending end walls 67, which depend downwardly over the transverse edges of grooves 63 (FIG. 4). As can be seen by referring to FIGS. 3B, 4, and 5, anchor plate 65a is received within channel 63a and is secured in place by fasteners such as threaded bolts 69 which extend through the base wall 63ab which defines the bottom of channel 63a and then through the anchor plate 65a in the manner shown in FIG. 5.

To pivotally support leg assemblies 16 and 18 relative to the support platform 14, novel leg support means are provided. These leg support means here comprise four cradle-like support assemblies 76 each of which includes a concave portion 76a that is disposed between spaced-apart wing-like elements 76b. The two pairs of cradle assemblies are connected to base walls 63ab in the manner shown in FIGS. 3A, 3B and 5 by suitable connectors such as the previously identified threaded connectors 69 which extend through wind-like portions 76b, through base wall 63ab, and into anchor plates 65a in the manner best seen in FIGS. 3B and 5. Also forming a part of each cradle assembly 76 is an end plate 76c which is connected to reinforcement panel 26 as well as to reinforcement frame 44 by means of elongated threaded fasteners 79 (see also FIG. 5). More particularly, as best seen in FIG. 4, connectors 79 extend through end plate 76c, through wall 40a of panel 26, through end walls 67 of the anchor plates and then into protuberances 45 which are formed internally of frame assembly 44. Cradles 76 along with convex channels 26c (FIG. 5) formed in panel 26, function as bearing means for rotatably supporting the extremities 80a of each of the horizontally extending, generally tubular shaped, axle-like members 80 which comprise a part of the leg assemblies 16 and 18 of the invention (FIG. 2).

Also forming a part of each of the leg assemblies 16 and 18 is a yoke-like member 82, the arms 82a of which are pivotally connected to the downwardly extending legs of each of the leg assemblies. Pivotally connected to yoke 82 is a connector rod 84 which functions to pivotally interconnect yoke 82 with a plate-like member 86 which is, in turn, affixed by threaded fasteners 86a to base wall 63bb of channel 63b and to anchor plates 65b (FIGS. 3A and 3B). With this construction, leg assembly 16 can pivot in the manner illustrated in the drawings from its first extended position shown in FIG. 2B to its collapsed stowed position shown in FIG. 3B. Similarly leg assembly 18 can pivot from an extended position into the stowed position shown in FIG. 3A. It is to be understood that various types of both fixed and pivoting leg assemblies can be connected to platform 14 and various types of mechanisms can be used to interconnect the leg assemblies with the platform.

In constructing the support platform of the invention, reinforcement frame 44 is assembled together in the manner previously described with the four corner members 48 being securely interconnected with members 44a and 44b in the manner illustrated in FIG. 10. As shown in FIGS. 4 and 5, the frame assemblage is then seated into channel 40. With frame 44 thusly seated, anchor plates 65a, 65b, and 65c are positioned within their respective anchor-plate receiving grooves 63a, 63b, and 63c in the manner also shown in FIGS. 4 and 5.

Next, the four cradle assemblies 76 are placed over the ends 80a of the tubular members or axles 80 of the leg assemblies in the manner shown in FIGS. 3A and 3B and the cradle assemblies are then connected to the structural panel using the previously identified threaded fasteners 69 and 79. In this regard, it is to be noted that, as previously mentioned, the interior wall surface 44i of frame assembly 44 is provided with portions 45 of substantially increased wall thickness which receive the self-tapping, threaded connectors 79 (FIG. 4). This construction provides extra rigidity to the structure to enable smooth, vibration free rotation of the axle members 80 within the convex portions 26c of the reinforcement panel and the central portions 76a of the cradles. To complete the assembly of the various structural components of support 14, rim assembly 56 is inserted into peripheral channel 42 in the manner shown in FIG. 5. To complete the alternating protuberance and cavity pattern of the central portion of the reinforcement panel and to provide a core assembly in which the upstanding protuberances substantially cover the entire upper surface of the reinforcement core, specially configured reinforcement segments 90 are emplaced within channels 69 formed in the anchor plates (see FIGS. 2A and 9). So as to provide structural continuity, segments 90 have a surface configuration similar to that of the central portion 30 of panel 26. More particularly, each of he segments 90 has a plurality of upstanding protuberances 90a which are similar to protuberances 34 with each having a base portion, a top closure wall 90b, and a side wall 90c which interconnects the base portion and the top closure wall 90b (FIGS. 2A and 9).

With reinforcement segments 90 in position within the channels formed in the anchor plates 65, a suitable adhesive is sprayed, painted, rolled or otherwise deposited on closure walls 34b and 90b of the reinforcing panel and of the segments 90a. Cover 24 is then placed over the reinforcement panel assemblage so that the central portion of undersurface 24b of the support member rests upon the adhesive covered closure walls 34b and 90b of protuberances 34 and 90a. It is to be understood that a number of different kinds of readily commercially available adhesives can be used to securely bond support member 24 to the protuberances 34 and 90a which make up the structural core of the reinforcement panel.

Following the bonding step, trim member 60 is mated with the assemblage by inserting projection 60a into the circumferentially extending space 93 formed between frame 56 and outer wall 42a of the reinforcement panel. Member 60a is secured in place within channel 42 by the previously identified resiliently deformable protuberances 60c which securely grip the inner wall of the longitudinally extending and transversely extending members 56a and 56b of frame assembly 56. As shown in FIG. 5, with projection 60a in position within gap 93, the outer lip, or projection 60b, will circumscribe and frictionally engage skirt 24c of support member 24 thereby neatly and attractively trimming the underside of the support platform.

Referring next to FIGS. 11 and 12, an alternate form of support platform of the present invention is there illustrated. this form of support platform is identical in all respects to platform 14 and is constructed in the same manner using the same components as previously described save that a second partial reinforcement panel 126a is affixed to a full panel 126 which is of identical construction to panel 26 of the previously described embodiment. Panels 126 and 126a are assembled together in a back-to-back relationship in the manner shown in FIG. 12. The central portion of each of the panels 126 and 126a is provided with a multiplicity of upstanding, generally frustoconical shaped protuberances identified in FIG. 12 by the numerals 134 and 134a. Each of the protuberances 134 has a base portion 135, a closure wall 137, and a connecting wall 139 interconnecting base portion 135 and closure wall 137. Disposed intermediate protuberances 134 are generally frustoconically shaped cavities 141.

In assembling the platform of this latest form of the invention, full reinforcement panels 126 and partial reinforcement panel 126a are interconnected by bonding the closure walls 137 of panel 126a to the base walls 143 of cavities 141 of panel 126. After panels 126 and 126a have been thusly interconnected, cover 24 is placed over the assemblage thus formed and is bonded to panel 126 along the closure walls 137 of panel 126. As is apparent from a study of FIG. 12, this double reinforcement panel construction provides additional strength to the support platform and enables the upper or work surface of support member 24 to carry loads of very large magnitude.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A lightweight, high-strength folding table comprising:

(a) a support platform including:

(i) a support member having a generally planar first surface, a spaced apart second surface, and a side wall circumscribing said first surface;

(ii) a reinforcement panel connected to said second surface of said support member, said reinforcement panel having a central portion and a peripheral portion, said central portion having a multiplicity of spaced-apart, specially configured, protuberances, each said protuberance comprising:

a base portion;

a spaced-apart closure wall; and a tapered connecting wall interconnecting said base portion and said closure wall;

Said peripheral portion comprising:

a. a first channel circumscribing said central portion of said reinforcement panel; and b. a second channel circumscribing said first channel of said peripheral portion;

(iii) a reinforcement frame disposed within said first channel of said peripheral portion of said reinforcement panel; and (iv) an edge support frame disposed within said second channel of said peripheral portion of said reinforcement panel; and (b) first and second leg assemblies connected to said support platform, each said leg assembly comprising a pair of support legs pivotally connected to said support platform for folding between a first extended position and a second retracted position.

2. A folding table as defined in claim 1 in which said central portion of said reinforcement panel of said support platform is provided with a plurality of spaced apart anchor plate receiving channels and in which said support platform further includes a plurality of anchor plates disposed within said anchor plate receiving channels, each said pair of legs being connected to at least a selected one of said anchor plates.

3. A folding table as defined in claim 1 in which said support platform further includes a partial reinforcement panel connected to said first reinforcement panel, said partial reinforcement panel having a central portion provided with a multiplicity of specially configured outwardly extending protuberances, each said protuberance including:

(a) a base portion;

(b) a spaced apart closure wall; and (c) a connector wall interconnecting said base portion and said closure wall.

4. A folding table as defined in claim 1 in which said edge support frame comprises resiliently deformable corner members.

5. A lightweight, high-strength support platform for use in constructing plastic furniture, comprising:

(a) a support member having a generally planar first surface and a spaced-apart second surface; and (b) a plastic structural reinforcement panel connected to said support member, said panel having a central portion provided with a multiplicity of specially configured protuberances, a first, generally channel-shaped portion circumscribing said central portion and a second, generally channel-shaped portion circumscribing said first generally channel-shaped portion, said protuberances of said central portion extending toward said support member and comprising:

(i) a base portion;

(ii) a spaced-apart closure wall; and (iii) a tapered connecting wall interconnecting said base portion and said closure wall; and (c) a reinforcement frame disposed within said first generally channel-shaped portion, said support platform further including an edge support frame disposed within said second, generally channel-shaped portion.

6. A lightweight, high-strength support platform for use in constructing plastic furniture, comprising:

(a) a support member having a generally planar first surface and a spaced-apart second surface;

(b) a plastic structural reinforcement panel connected to said support member, said panel having a central portion provided with a multiplicity of specially configured protuberances and a first, generally channel-shaped portion circumscribing said central portion, said protuberances of said central portion extending toward said support member and comprising:

(i) a base portion;

(ii) a spaced-apart closure wall; and (iii) a tapered connecting wall interconnecting said base portion and said closure wall;

(c) a reinforcement frame disposed within said first generally channel-shaped portion;

(d) a thin plastic partial structural reinforcement panel connected to said first reinforcement panel, said partial structural reinforcement panel having a first surface provided with a multiplicity of specially configured outwardly extending protuberances each said protuberance including:

(i) a base portion;

(ii) a spaced apart closure wall; and (iii) a connector wall interconnecting said base portion and said closure wall.

7. A lightweight, high-strength table comprising:

(a) a support platform including a support member having a generally planar first surface and a spaced-apart second surface, said support platform further including a reinforcement panel connected to said support member, said reinforcement panel having a central portion and a peripheral portion including a first generally channel-shaped portion circumscribing said central portion and a second generally channel-shaped portion circumscribing said first, generally channel-shaped portion, said central portion having a multiplicity of spaced-apart, specially configured protuberances, each said protuberance comprising:

(i) a base portion;

(ii) a spaced-apart closure wall; and (iii) a tapered connecting wall interconnecting said base portion and said closure wall, said support platform further including a reinforcement frame disposed within said first generally channel shaped portion and an edge support frame disposed within said second generally channel shaped portion; and (b) at least one pair of legs connected to said support platform.

* * * * *